US011602932B2

(12) United States Patent
Martin et al.

(10) Patent No.: US 11,602,932 B2
(45) Date of Patent: Mar. 14, 2023

(54) ZONAL FIRING SIGNAL ADJUSTMENTS

(71) Applicant: Hewlett-Packard Development Company, L.P., Spring, TX (US)

(72) Inventors: Eric Martin, Corvallis, OR (US); Daryl E. Anderson, Corvallis, OR (US); James Michael Gardner, Corvallis, OR (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 17/045,520

(22) PCT Filed: Jun. 11, 2018

(86) PCT No.: PCT/US2018/036828

§ 371 (c)(1),
(2) Date: Oct. 6, 2020

(87) PCT Pub. No.: WO2019/240746

PCT Pub. Date: Dec. 19, 2019

(65) Prior Publication Data

US 2021/0402761 A1 Dec. 30, 2021

(51) Int. Cl.
*B41J 2/045* (2006.01)

(52) U.S. Cl.
CPC ..... *B41J 2/04573* (2013.01); *B41J 2/0455* (2013.01); *B41J 2/0458* (2013.01); *B41J 2/04543* (2013.01); *B41J 2/04546* (2013.01); *B41J 2/04563* (2013.01); *B41J 2/04588* (2013.01); *B41J 2/04591* (2013.01); *B41J 2/04598* (2013.01)

(58) Field of Classification Search
CPC ..... B41J 2/04591
See application file for complete search history.

(56) References Cited

U.S. PATENT DOCUMENTS

| | | | | |
|---|---|---|---|---|
| 5,426,457 | A | 6/1995 | Raskin | |
| 6,280,012 | B1 * | 8/2001 | Schloeman | B41J 2/04541 347/12 |
| 6,390,580 | B1 * | 5/2002 | Anderson | B41J 2/04586 347/12 |
| 6,435,668 | B1 | 8/2002 | Barbour et al. | |
| 6,565,178 | B1 * | 5/2003 | Giere | B41J 2/04541 347/17 |

(Continued)

FOREIGN PATENT DOCUMENTS

| | | |
|---|---|---|
| EP | 1314562 A2 | 5/2003 |
| EP | 3212412 A1 | 9/2017 |

(Continued)

*Primary Examiner* — Shelby L Fidler
(74) *Attorney, Agent, or Firm* — Foley & Lardner LLP

(57) ABSTRACT

In one example in accordance with the present disclosure, a fluidic die is described. The fluidic die includes a number of zones. Each zone includes a number of sets of fluidic devices. Each fluidic device includes a fluid chamber and a fluid actuator disposed in the chamber. Each fluidic device also includes a sensor to sense a characteristic of the zone and an adjustment device. The adjustment device 1) delays a firing signal received from a previous zone as it passes by each set of fluidic devices and 2) adjusts the firing signal as it enters the zone based on a sensed characteristic.

20 Claims, 11 Drawing Sheets

(56) References Cited

U.S. PATENT DOCUMENTS

| | | | | |
|---|---|---|---|---|
| 6,726,300 | B2 | 4/2004 | Schloeman et al. | |
| 7,891,749 | B2 | 2/2011 | Sheahan et al. | |
| 8,011,747 | B2 | 9/2011 | Walmsley et al. | |
| 9,862,187 | B1 * | 1/2018 | Mu | B41J 2/04591 |
| 9,981,465 | B1 | 5/2018 | Mu et al. | |
| 2001/0038410 | A1 * | 11/2001 | Kubota | B41J 2/04565 347/108 |
| 2002/0093544 | A1 * | 7/2002 | Schloeman | B41J 2/155 347/12 |
| 2003/0202025 | A1 * | 10/2003 | Schloeman | B41J 2/04573 347/12 |
| 2010/0171777 | A1 | 7/2010 | Han | |
| 2012/0120138 | A1 | 5/2012 | Banerjee et al. | |
| 2012/0218334 | A1 | 8/2012 | Bergstedt et al. | |
| 2014/0092155 | A1 * | 4/2014 | Suzuki | B41J 2/0458 347/14 |
| 2017/0050428 | A1 * | 2/2017 | Anderson | B41J 2/04541 |
| 2017/0355188 | A1 | 12/2017 | Anderson et al. | |

FOREIGN PATENT DOCUMENTS

| | | | |
|---|---|---|---|
| WO | 2016/068888 | A1 | 5/2016 |
| WO | WO-2018017054 | | 1/2018 |

* cited by examiner

| Zone | Value | DV0 | ZAV | Accumulated |
|---|---|---|---|---|
| 0 | 50 | | | |
| 1 | 51 | -1 | -1 | -1 |
| 2 | 51 | -1 | 0 | -1 |
| 3 | 53 | -3 | -1 | -2 |
| 4 | 55 | -5 | -1 | -3 |
| 5 | 54 | -4 | -1 | -4 |
| 6 | 54 | -4 | 0 | -4 |
| 7 | 52 | -2 | +1 | -3 |
| 8 | 52 | -2 | +1 | -2 |
| 9 | 51 | -1 | +1 | -1 |
| 10 | 51 | -1 | 0 | -1 |

Fig. 10

ZONAL FIRING SIGNAL ADJUSTMENTS

BACKGROUND

A fluidic die may be a component of a fluidic system. The fluidic die includes components that manipulate fluid flowing through the system. For example, a fluidic ejection die, which is an example of a fluidic die, includes a number of nozzles that eject fluid. The fluidic die also includes non-ejecting actuators such as micro-recirculation pumps that move fluid through the fluidic die. Through these nozzles and pumps, fluid, such as ink and fusing agent among others, is ejected or moved.

BRIEF DESCRIPTION OF THE DRAWINGS

The accompanying drawings illustrate various examples of the principles described herein and are part of the specification. The illustrated examples are given merely for illustration, and do not limit the scope of the claims.

FIG. 10 is a table for zonal firing signal adjustments, according to an example of the principles described herein.

Figure 1:
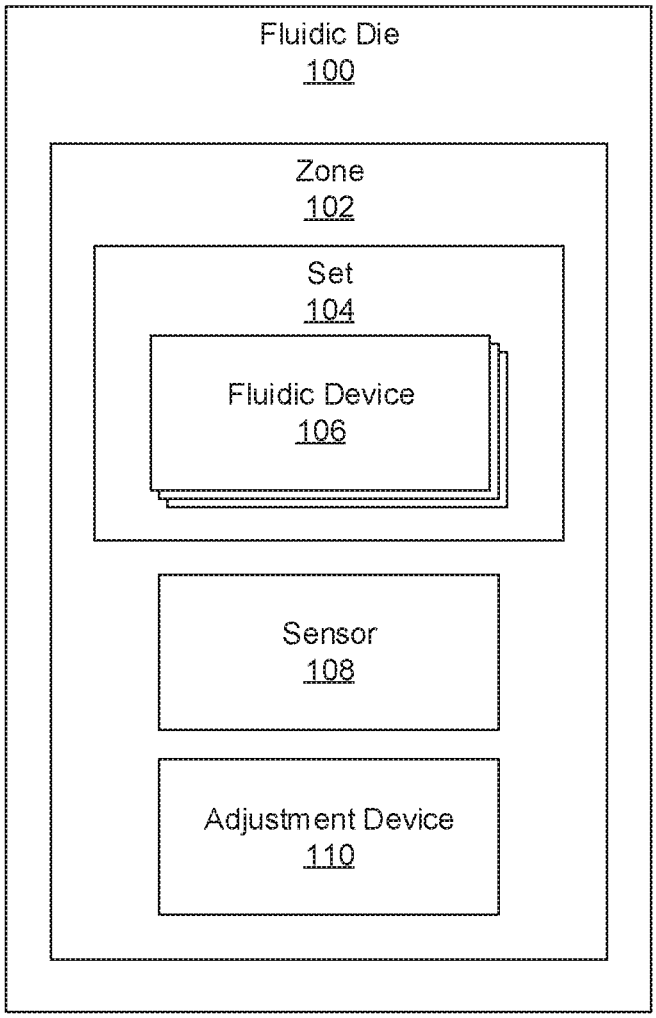
FIG. 1 is a block diagram of a fluidic die for zonal firing signal adjustments, according to an example of the principles described herein.

Throughout the drawings, identical reference numbers designate similar, but not necessarily identical, elements. The figures are not necessarily to scale, and the size of some parts may be exaggerated to more clearly illustrate the example shown. Moreover, the drawings provide examples and/or implementations consistent with the description; however, the description is not limited to the examples and/or implementations provided in the drawings.

DETAILED DESCRIPTION

Fluidic dies, as used herein, may describe a variety of types of integrated devices with which small volumes of fluid (e.g., milliliters, microliters, picoliters, etc.) may be pumped, mixed, analyzed, ejected, etc. Such fluidic dies may include ejection dies, such as those found in printers, additive manufacturing distributor components, digital titration components, and/or other such devices with which volumes of fluid may be selectively and controllably ejected.

In a specific example, these fluidic die are found in any number of printing devices such as inkjet printers, multi-function printers (MFPs), and additive manufacturing apparatuses. The fluidic systems in these devices are used for precisely, and rapidly, dispensing small volumes of fluid. For example, in an additive manufacturing apparatus, the fluid ejection system dispenses fusing agent and/or detailing agent. The fusing agent is deposited on a build material, which fusing agent facilitates the hardening of build material to form a three-dimensional product. The detailing agent may be used to more precisely define the boundaries between fused regions and unfused regions.

Other fluid systems dispense ink on a two-dimensional print medium such as paper. For example, during inkjet printing, fluid is directed to a fluid ejection die. Depending on the content to be printed, the device in which the fluid ejection system is disposed determines the time and position at which the ink drops are to be released/ejected onto the print medium. In this way, the fluid ejection die releases multiple ink drops over a predefined area to produce a representation of the image content to be printed. Besides paper, other forms of print media may also be used.

Accordingly, as has been described, the systems and methods described herein may be implemented in a two-dimensional printing, i.e., depositing fluid on a substrate, and in three-dimensional printing, i.e., depositing a fusing agent or other functional agent on a material base to form a three-dimensional printed product.

Each fluidic die includes a fluid actuator to eject/move fluid. In a fluidic ejection die, a fluid actuator may be disposed in an ejection chamber, which chamber is coupled to an opening, which may be referred to as a nozzle. The fluid actuator in this case may be referred to as an ejector that, upon actuation, causes ejection of a fluid drop via the opening.

Fluid actuators may also be pumps. For example, some fluidic dies include microfluidic channels. A microfluidic channel is a channel of sufficiently small size (e.g., of nanometer sized scale, micrometer sized scale, millimeter sized scale, etc.) to facilitate conveyance of small volumes of fluid (e.g., picoliter scale, nanoliter scale, microliter scale, milliliter scale, etc.). Fluidic actuators may be disposed within these channels which, upon activation, may generate fluid displacement in the microfluidic channel.

Examples of fluid actuators include a piezoelectric membrane based actuator, a thermal resistor based actuator, an electrostatic membrane actuator, a mechanical/impact driven membrane actuator, a magneto-strictive drive actuator, or other such elements that may cause displacement of fluid responsive to electrical actuation. A fluidic die may include a plurality of fluid actuators, which may be referred to as an array of fluid actuators.

While such fluidic systems and fluidic dies undoubtedly have advanced the field of precise fluid delivery, some conditions impact their effectiveness. For example, the thermal state of the fluidic die may affect how fluid is ejected from a fluidic die. For example, at locations where the fluidic die is warmer, the relationship between drop weight and fire pulse energy changes. That is, under one set of temperature conditions, a firing pulse having certain characteristics will generate fluid drops having a particular weight. Under different temperature conditions that same firing pulse will generate fluid drops having a different weight. In some examples, different drop weights may affect the appearance in two-dimensional printing. For example, the different drop weights result in difference in fluid saturation, which in 2D printing can manifest itself with light color areas on certain parts of the printed output and darker color areas on other areas of the printed output.

A thermal gradient can form across a fluidic die. For example, as the circuitry and other components of a fluidic die operate to manipulate fluid, heat is generated and absorbed by the substrate on which the components are disposed. In other words, the natural operation of the fluidic die generates heat, which heat can have a negative impact on print quality or in general, the consistency of fluidic manipulation. In some cases, localized thermal gradients of up to approximately 15 degrees Celsius can exist across a fluidic die.

Note that while specific reference is made to a thermal profile affecting drop weight, any number of other die characteristics may affect the drop weight. For example, the fluidic die may see a parasitic drop across a power distribution network, which similarly generates a gradient across the fluidic die that may affect localized drop weights.

As yet another example, fluid characteristics, such as viscosity can affect drop ejection and drop tail break up. Both of these characteristics can impact drop velocity and drop weight. In this example a refill curve of a drop bubble formation cycle can measure how quickly fluid flows back into a fluid chamber. This refill curve is a function of the viscosity.

As yet another example, over time, actuators may wear out non-uniformly. The wearing out of an actuator may affect its performance so as to cause drop variation.

Accordingly, the present specification describes a fluidic die and fluidic system that account for such thermal (and other) gradients that result in varying drop weights. That is, the present system locally modulates fire pulses based on local thermal, or other, sensed characteristics of the die.

Specifically, a fluidic die is divided into zones, with each zone including a set of fluidic devices and a sensor. Using the specific example of thermal sensing, a temperature sensor detects a temperature of the zone. A controller of the system determines an amount that the firing signal in that zone should be adjusted based on the output of the temperature sensor, and adjusts the firing signal accordingly. Such an operation is carried out for each zone. In other words, the firing signal is adjusted per zone, such that the thermal characteristics of each zone are addressed individually, thus countering the effects of the thermal state of that zone.

Specifically, the present specification describes a fluidic die. The fluidic die includes a number of zones. Each zone includes a number of sets of fluidic devices. Each fluidic device includes a fluid chamber and a fluid actuator disposed in the chamber. Each zone also includes a sensor to sense a characteristic of the zone. Each zone also includes an adjustment device. The adjustment device 1) delays a firing signal received from a previous zone as it passes by each set of fluidic devices and 2) adjusts the firing signal as it enters the zone based on a sensed characteristic.

The present specification also describes a fluidic system. The fluidic system includes the fluidic die and a controller. The controller is coupled to temperature sensors on the fluidic die and the adjustment devices for multiple zones on the fluidic die. The controller determines an adjustment value for the firing signal at each zone. As will be described below, the controller may be located on the fluidic die or off the fluidic die.

The present specification also describes a method. According to the method, a sensed characteristic for a zone is received from a sensor of the fluidic die. The sensor is coupled to a zone of multiple sets of fluidic devices. Based on the sensed characteristic, an adjustment value to apply to a firing signal received at the zone from a previous zone is determined and the firing signal is adjusted at the zone, based on this adjustment value.

In summary, using such a fluidic die 1) provides for the identification of any characteristic gradient that may exist across the fluidic die: 2) compensates for the characteristic gradient, or any offset from a base value, based on localized sensing systems; 3) provides on-die calculation of zone adjustment values; 4) provides self-contained thermal accommodation; 5) provides such compensation using minimal additional circuitry components; and 6) is relatively low cost. However, the devices disclosed herein may address other matters and deficiencies in a number of technical areas.

As used in the present specification and in the appended claims, the term "fluidic die" refers to a component of a fluidic system that includes a number of fluid actuators. A fluidic die includes fluidic ejection dies and non-ejecting fluidic dies.

Further, as used in the present specification and in the appended claims, the term "fluidic device" refers to an individual component of a fluidic die that manipulates fluid. The fluidic device includes at least a chamber and an actuator. In particular example of a fluidic device is a fluidic ejection device which refers to an individual component of a fluid ejection die that dispenses fluid onto a surface. The fluidic ejection device includes at least an ejection chamber, an ejector actuator, and an opening.

Further, as used in the present specification and in the appended claims, the term "set" refers to a grouping of fluidic devices. Each group may include fluidic devices that are adjacent one another.

Similarly, as used in the present specification and in the appended claims, the term "zone" refers to a grouping of sets of fluidic devices. Each zone may correspond to one sensor, such as a temperature sensor that indicates a thermal state of that zone.

Further, as used in the present specification and in the appended claims, the term "actuator" refers to an ejecting actuator and/or a non-ejecting actuator. For example, an ejecting actuator operates to eject fluid from the fluid ejection die. A recirculation pump, which is an example of a non-ejecting actuator, moves fluid through the fluid slots, channels, and pathways within the fluidic die.

As used in the present specification and in the appended claims, the term "firing signal" refers to a firing signal as it is received at a particular zone. A firing signal may include multiple pulses. For example a firing signal may include a number of pulses. For example, a firing signal may include a precursor pulse and a firing pulse, among others.

By comparison, an "adjusted firing signal" refers to a firing signal that has been adjusted, i.e., had its properties changed and been delayed, in the zone. This adjusted firing signal is then propagated to each zone on the fluidic die to be further delayed (per set) and adjusted (per zone).

Further, as used in the present specification and in the appended claims, the term "adjust" refers to a change in the physical properties of the firing signal, such things as a magnitude, length, and number of pulses in a firing signal. By comparison, the term "delay refers to a change in the start time of the firing signal.

Turning now to the figures, FIG. 1 is a block diagram of a fluidic die (100) for zonal firing signal adjustments, according to an example of the principles described herein. As described above, the fluidic die (100) is a part of a fluidic system that houses components for ejecting fluid and/or transporting fluid along various pathways. In some examples, the fluidic die (100) is a microfluidic die (100). That is, the channels, slots, and reservoirs on the microfluidic die (100) may be on a micrometer, or smaller, scale to facilitate conveyance of small volumes of fluid (e.g., picoliter scale, nanoliter scale, microliter scale, milliliter scale, etc). The fluid that is ejected and moved throughout the fluidic die (100) can be of various types including ink, biochemical agents, detailing agent and/or fusing agents. The fluid is moved and/or ejected via an array of fluidic devices (106). Any number of fluidic devices (106) may be formed on the fluidic die (100).

The fluidic die (100) includes a number of zones (102) with each zone (102) including a grouping of sets (104) of fluidic devices (106). The fluidic device (106) is a component that includes a fluid chamber and a fluid actuator. Fluid held in the fluid chamber is moved via the fluid actuator which is disposed in the fluid chamber. The fluid chamber may take many forms. A specific example of such a fluid chamber is an ejection chamber where fluid is held prior to ejection from the fluidic die (100). In another example, the fluid chamber may be a channel, or conduit through which the fluid travels. In yet another example, the fluid chamber may be a reservoir where a fluid is held.

The fluid actuators work to eject fluid from, or move fluid throughout, the fluidic die (100). The fluid chambers and fluid actuators may be of varying types. For example, the fluid chamber may be an ejection chamber wherein fluid is expelled from the fluidic die (100) onto a surface for example such as paper or a 3D build bed. In this example, the fluid actuator may be an ejector that ejects fluid through an opening of the fluid chamber.

In another example, the fluid chamber is a channel through which fluid flows. That is, the fluidic die (100) may include an array of microfluidic channels. Each microfluidic channel includes a fluid actuator that is a fluid pump. In this example, the fluid pump, when activated, displaces fluid within the microfluidic channel. While the present specification may make reference to particular types of fluid actuators, the fluidic die (100) may include any number and type of fluid actuators.

These fluid actuators may rely on various mechanisms to eject/move fluid. For example, an ejector may be a firing resistor. The firing resistor heats up in response to an applied voltage. As the firing resistor heats up, a portion of the fluid in an ejection chamber vaporizes to generate a bubble. This bubble pushes fluid out an opening of the fluid chamber and onto a print medium. As the vaporized fluid bubble collapses, fluid is drawn into the ejection chamber from a passage that connects the fluid chamber to a fluid feed slot in the fluidic die (100), and the process repeats. In this example, the fluidic die (100) may be a thermal inkjet (TIJ) fluidic die (100).

In another example, the fluid actuator may be a piezoelectric device. As a voltage is applied, the piezoelectric device changes shape which generates a pressure pulse in the fluid chamber that pushes the fluid through the chamber. In this example, the fluidic die (100) may be a piezoelectric inkjet (PIJ) fluidic die (100). In an example, the actuators are formed as columns or as 2D arrays on the fluidic die (100).

A set (104) may include any number of fluidic devices (106) and a zone (102) may include any number of sets (104). Moreover, a fluidic die (100) may include any number of columns, each column having any number of sets (104).

To fire a fluidic actuator in a fluidic device (106), a firing signal is applied to the actuator. A global firing signal is generated at a controller and may include one or multiple pulses. For example, a firing signal may include a precursor pulse and a firing pulse which are separated in time. The energy supplied to the actuator, and thereby that in part defines the drop weight, may be controlled by the width of the pulses. Other characteristics, such as the magnitude, also affect the drop weight.

As described above, any number of characteristics of the fluidic die (100) may change over the length of the fluidic die (100). For example, a temperature of the fluidic die (100) may be greater near its center as opposed to the edges. This temperature gradient, and the other gradients that may exist, can affect uniform fluidic deposition. Accordingly, the fluidic die (100) includes components that compensate for such gradients to ensure uniform fluidic manipulation. Specifically, the fluidic die (100) includes a sensor (108) per zone (102) to detect the characteristic for that zone (102). For example, each zone (102) may include a temperature sensor (108) that detects a temperature at that location. Accordingly, a temperature profile for the fluidic die (100) is generated with measurements per zone (102). With such a temperature profile, the firing signal can be adjusted in each zone (102) such that energy is delivered to each zone (102) to generate a drop having planned characteristics.

As described above, the sensors (108) may be temperature sensors. In one example, the temperature sensor is a diode which is a junction device that measures temperature at a local point. In another example, the temperature sensor may be a resistor which may be a device to measure a temperature at a point, or a serpentine structure that averages temperature along its length, giving an average temperature of the zone (102).

To account for the difference of the characteristic, i.e., temperature, in a particular zone (102) and to otherwise offset the firing signal as it is propagated through the zone (102), each zone (102) includes an adjustment device (110). The adjustment device (110) has at least two functions. First, the adjustment device (110) delays the firing signal at each set (104) within the zone (102). That is, a firing signal is received from a previous zone (102) and is delayed at each set (104) within the zone (102). Such a delay is to satisfy fluidic and electrical constraint on a print system. That is, if all fluidic devices (106) within a set (104), zone (102), or column were actuated at the same time, a current surge may result, which could negatively impact print consistency since a drop in the power rail due to the surge would lower the firing energy, thus affecting the drop size. The power source could even damage the fluidic die (100) and associated components.

Such a delay is introduced via a delay chain, which is a series of delay elements, each which delay the firing signal as it passes to its associated set (104). That is, a global controller generates a firing signal which feeds into a first zone (102). As it propagates, the firing signal is delayed at each set (104). Doing so reduces the current on the fluidic die (100) at any given time.

The adjustment device (110) also adjusts the firing signal as it enters the zone (102) based on a sensed characteristic. For example, a controller receives a sensed characteristic of the zone (102) and determines an adjustment to be made to the firing signal as it passes through that zone (102) based on the received sensed characteristic. The controller then sends the adjustment value to the adjustment device (110) and the adjustment device (110) alters the firing signal for that zone (102) based on the adjustment value. The firing signal is similarly adjusted for each zone (102) on the fluidic die (100) such that each zone (102) effectuates the desired drop size and weight, in spite of the effects of sensed characteristic on that zone (102).

Note that in this example, the adjustment value for a zone (102) is relative to an adjacent zone (102). That is, the amount that a firing signal is adjusted in a particular zone (102) is based on the adjustments already made to that firing signal in a previous zone (102). For example, at zones 1-5 of a fluidic die (100), different adjustments may be made to the firing signal as it is received at each zone from a previous zone. In this example, any adjustments at zone 6 start from the adjusted firing signal exiting zone 5.

As an example, in a first zone (102) near an edge of the fluidic die (100), a particular firing signal may be passed which generates drops of a certain weight. In a second zone (102) an increased temperature in that zone (102) may generate drops of a greater weight. Accordingly, the adjustment device (110) may shorten the firing signal in that second zone (102) such that drops are generated with the same weight as those generated in the first zone (102) in spite of the temperature difference between the two zones (102). Accordingly, fluid drops of the same weight are generated with less energy input at the second zone (102). Using less energy in this fashion reduces the heat input to the fluidic die (100) and reduces the thermal gradients that may exist across the zones (102).

Such a fluidic die (100) accounts for thermal variance, or other variance, across a fluidic die (100) by adjusting the firing signal as it propagates through the different zones (102). By doing so at a zonal level, as opposed to at a fluidic die (100) level, a higher resolution correction can be applied to the fluidic die (100) thus resulting in a fluid ejection that is more accurate to the intended result.

Figure 2:
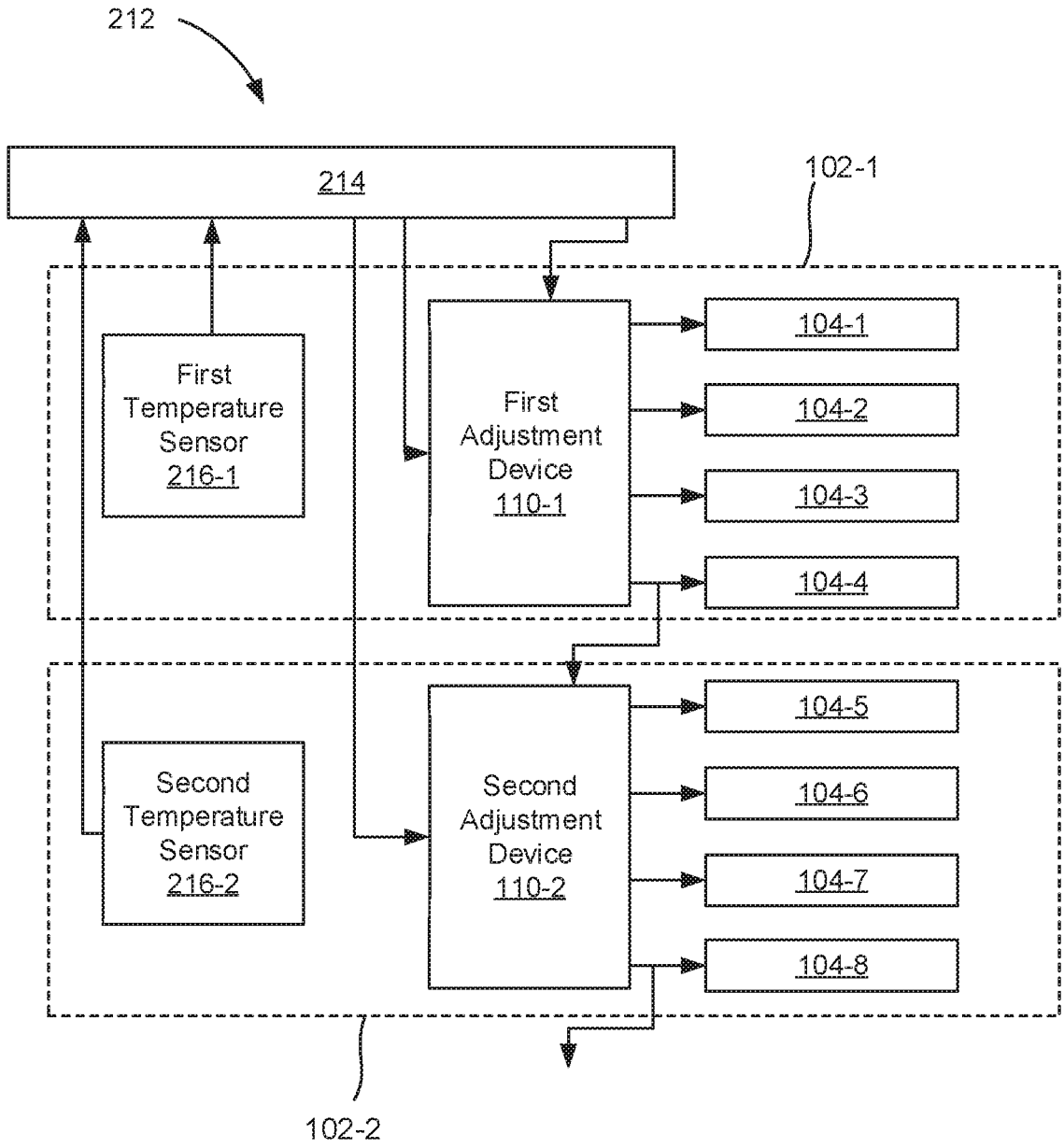
FIG. 2 is a schematic diagram of a fluidic system for zonal firing signal adjustments, according to an example of the principles described herein.

FIG. 2 is a schematic diagram of a fluidic system (212) for zonal firing signal adjustments, according to an example of the principles described herein. The fluidic system (212) includes a fluidic die (FIG. 1, 100) and a controller (214), which may be on- or off-die. As described above, each fluidic die (FIG. 1, 100) is divided into a number of zones (102-1, 102-2). While FIG. 2 depicts two zones (102-1, 102-2), a fluidic die (FIG. 1, 100) may include any number of zones (102). As described above, each zone (102) includes a number of sets (104) of fluidic devices (FIG. 1, 106). While FIG. 2 depicts four sets (104-1, 104-2, 104-3, 104-4) in the first zone (102-1) and four sets (104-5, 104-6, 104-7, 104-8) in the second zone (102-2), a zone (102) may include any number of sets (104).

Also as described above, each zone (102) has an adjustment device (110) to delay a firing signal received from the previous zone (102) as it passes by each set (104). That is, the first adjustment device (110-1) receives a firing signal from a previous zone (102), which previous zone (102) may have adjusted and delayed the firing signal. The first adjustment device (110-1) delays the firing signal as it passes to the first set (104-1) and further delays the firing signal as it passes the second, third and fourth sets (104-2, 104-3, 104-4). In this regard, the first adjustment device (110-1) may include a delay chain with a delay element per set (104). Note that in this example, the firing signal is delayed at each set (104), such that each set's firing event starts and ends at different points of time. This is done to prevent current surge that could result from firing too many fluidic devices (FIG. 1, 106) at the same time.

The second adjustment device (110-2) then receives a firing signal from the first zone (102-1), specifically the firing signal as it has been delayed from the last set (104-4) of the first zone (102-1) and as it has been adjusted in the first zone (102-1). That is, the first zone (102-1) passes an adjusted firing signal to the second adjustment device (110-2) in the second zone (102-2). The second adjustment device (110-2) then delays the firing signal as it passes to the fifth set (104-5) and further delays the firing signal as it passes the sixth set (104-6). In this regard, the second adjustment device (110-2) may include a delay chain with a delay element per set (104), such that each set's firing event starts and end at different points of time.

As described above, the adjustment devices (110) also adjust the firing signal based on a sensed characteristic at the zone (110) to account for variation in drop weight based on the sensed characteristic. For example, a first temperature sensor (216-1) may determine that the first zone (102-1) has a first temperature. This is passed to a controller (214) which maps the temperature to an adjustment value. The adjustment value indicates a degree to which the firing signal should be adjusted at the first zone (102-1). This adjustment value is passed to the first adjustment device (110-1) which, in addition to delaying the firing signal at each set (104), also adjusts a characteristic of the firing signal itself to ensure a desired drop weight is generated at the first zone (102-1). In other words, the firing signal may be 1) delayed multiple times per zone (102), i.e., per set (104) within the zone (102) and 2) adjusted one time per zone (102).

In some examples, adjusting the firing signal may include adjusting a width of the firing signal or adjusting a width of a pulse which forms a portion of the firing signal. Adjusting the width of the firing pulse/signal adjusts the amount of energy delivered. Thus, as an increase in temperature may indicate that less energy should be provided to form a particular drop weight, a zone (102) that is warmer than its predecessor may have a firing signal that is shorter than its predecessor by an amount to ensure that the drop weights between the two zones (102) are the same, in spite of any difference in temperature.

Similarly, a second temperature sensor (216-2) may determine that the second zone (102-2) has a second temperature, which second temperature is greater than the first temperature. This second temperature is passed to the controller (214) which maps the temperature to an adjustment value, which adjustment value indicates a degree to which the firing signal should be adjusted at the second zone (102-2), relative to the adjusted firing signal from the first zone (102-2). This value is passed to the second adjustment device (110-2) which, in addition to delaying the firing signal at each set (104), also adjusts a characteristic of the signal itself to ensure a desired drop weight is generated at the second zone (102-2).

Note that in this example, the adjustment value of the firing signal at the second zone (102-2) may be relative to the signal passed from the first zone (102-1). That is, each zone (102) passes an adjusted firing signal to a subsequent zone (102), and that subsequent zone (102) further adjusts the adjusted firing signal based on adjustments determined by the controller (214).

Figure 9:
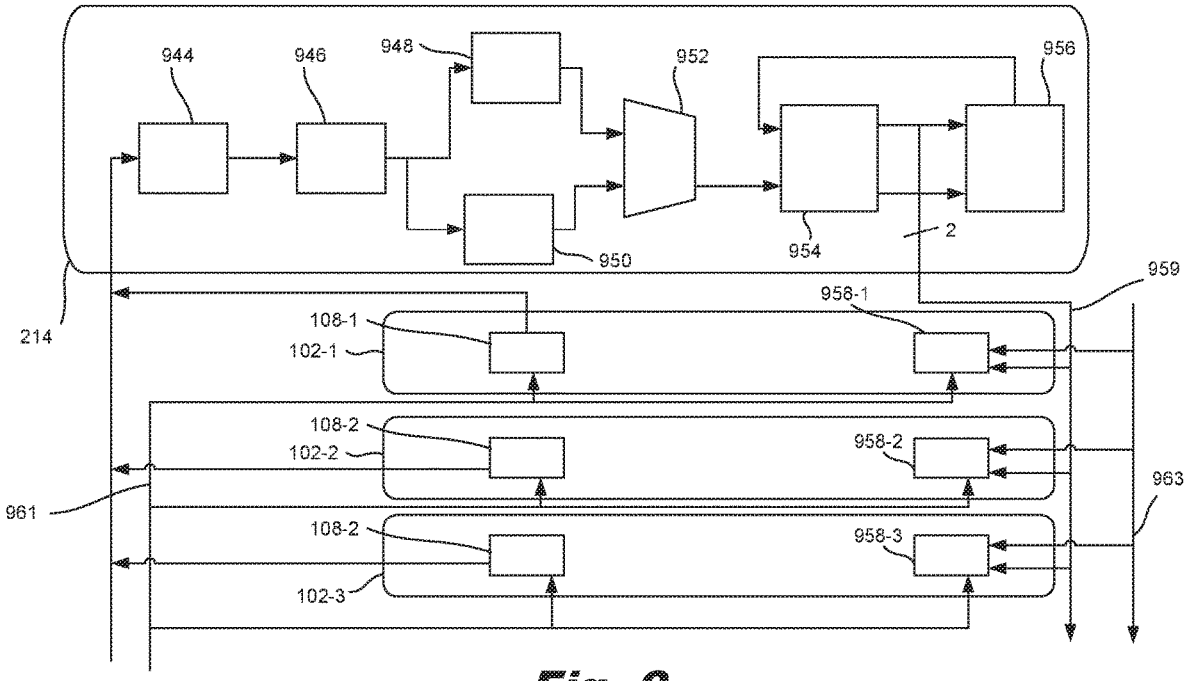
FIG. 9 is a schematic diagram of a controller of the fluidic system for zonal firing signal adjustments, according to an example of the principles described herein.

The system (212) also includes a controller (214) that is coupled to temperature sensors (216) of each zone (102-1, 102-2) as well as adjustment devices (110) of each zone (102-1, 102-2). As described above, the controller (214) determines an adjustment value by which the firing signal, as it passes through each respective zone (102), should be adjusted. FIG. 9 provides an example of how a controller (214) adjusts the firing signals. In other words, the outputs from the controller (214) to each adjustment device (110) are based on local temperature sensor (216) measurements in each zone (102). Thus, a localized correction can be applied to the sets (104) within that zone (102) to ensure a desired drop size. Note that in some examples, the controller (214) is disposed on the fluidic die (FIG. 1,100) while in other examples, the controller (214) is disposed off the die and in this case may be multiplexed to multiple fluidic die (FIG. 1, 100) to determine adjustment values for each of the fluidic die (FIG. 1, 100).

Figure 3:
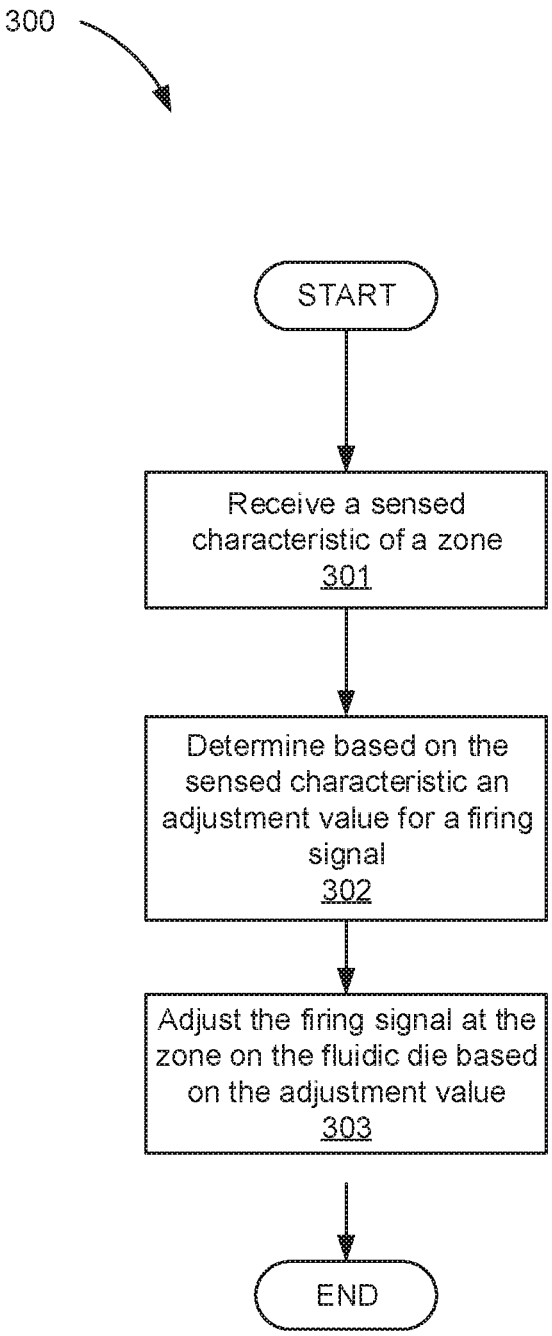
FIG. 3 is a flow chart of a method for zonal firing signal adjustment, according to an example of the principles described herein.

FIG. 3 is a flow chart of a method (300) for zonal firing signal adjustment, according to an example of the principles described herein. According to the method (300), a sensed characteristic fora zone (FIG. 1, 102) is received (block 301). Specifically, a controller (FIG. 2, 214) of a fluid system (FIG. 2, 212) receives (block 301) a sensed characteristic from a sensor (FIG. 1, 108) disposed on a fluidic die (FIG. 1, 100) and associated with that zone (FIG. 1, 102). That is, each zone (FIG. 1, 102) includes a sensor (FIG. 1, 108), such as a temperature sensor (FIG. 2, 216). While specific reference is made to a temperature sensor (FIG. 2, 216), other types of sensors (FIG. 1, 108) may be used such as an electrical sensor to determine a degree of parasitic loss along the firing chain. As described above, the sensed characteristic is local to a zone (FIG. 1, 102). That is, each zone (FIG. 1, 102) sends sensed characteristics specific to that zone (FIG. 1, 102), to the controller (FIG. 2, 214).

Based on the sensed characteristics, the controller (FIG. 2, 214) determines (block 302) an adjustment value to apply to the firing signals at each zone (FIG. 1, 102). That is, for each zone (FIG. 1, 102), the controller (FIG. 2, 214) determines how much the firing signal in the zone (FIG. 1, 102) should be adjusted relative to how it is received from a preceding zone (FIG. 1, 102). For example, it may be determined that a first zone (FIG. 2, 102-1) has a first temperature that is greater than a reference temperature. Accordingly, an adjustment value is determined which could shorten the firing signal such that less energy is delivered. The amount to which the firing signal is shortened is based on how much it has already been shortened via previous adjustments.

As increased die temperature results in a larger drop weight for a given energy, reducing the energy for a warmer zone (FIG. 1, 102) would result in a same size drop, in spite of the change in temperature. Accordingly, the adjustment value may be determined (block 302) such that the drop weight of the first zone (FIG. 2, 102-1) is the same as the preceding zone (FIG. 1,102), in spite of the difference in temperature.

The firing signal as it is in the zone (FIG. 1, 102) is then adjusted (block 303) at the zone (FIG. 1, 102) based on the adjustment value. As described above, adjusting (block 303) the firing signal may include changing the pulse width. Accordingly, adjusting (block 303) may include either extending, truncating, or maintaining the falling edge of the firing signal such that more, less, or the same amount of energy is delivered by the firing signal. The increase or decrease in the energy supplied by the firing signal operates to counter the effects of thermal variation between zones (FIG. 1, 102). In this example, given the increased temperature of the first zone (FIG. 2, 102-1) relative to the preceding zone temperature, the firing signal (including the fire pulse and/or the precursor pulse) may be truncated to deliver less energy, all while generating fluid drops having the same weight as those generated in the preceding zone (FIG. 1, 102). Note that while specific reference is made to adjusting a pulse width, other forms of adjustment may be implemented including for example, adjusting a magnitude of the pulses, or adjusting the quantity of pulses that make up the firing signal. Moreover, as noted above, reference to adjusting a firing signal includes adjustment to any one, or multiple, of the pulses that make up the firing signal.

The method (300) may be repeated for each zone (FIG. 1, 102) on the fluidic die (FIG. 1, 100). For example, a sensed characteristic for a second zone (FIG. 2, 102-2) is received (block 301). In this example, it may be determined that the second zone (FIG. 2, 102-2) has a temperature that is less than the temperature of the first zone (FIG. 2, 102-1). Accordingly, an adjustment value is determined which could lengthen the firing signal, as it is received from the first zone (FIG. 1, 102-1) and more particularly from the last set (FIG. 2, 104-4) of the first zone (FIG. 1, 102-1) such that more energy is delivered.

As reduced temperature results in a smaller drop weight for a given energy, increasing the energy for a cooler zone (FIG. 1, 102) would result in a same size drop, in spite of the change in energy. Accordingly, the adjustment value may be determined (block 302) such that the drop weight of the second zone (FIG. 2, 102-2) is the same as the preceding zone (FIG. 1,102) drop weight, in spite of the difference in temperature.

The firing signal as it is in the zone (FIG. 1, 102) is then adjusted (block 303) at the zone (FIG. 1, 102) based on the adjustment value. Accordingly, the method (300) as described herein provides for local customization of the firing signal such that each zone (FIG. 1, 102) generates drops as intended, rather than skewed by variation introduced by thermal gradients, or other gradients.

Figure 4:
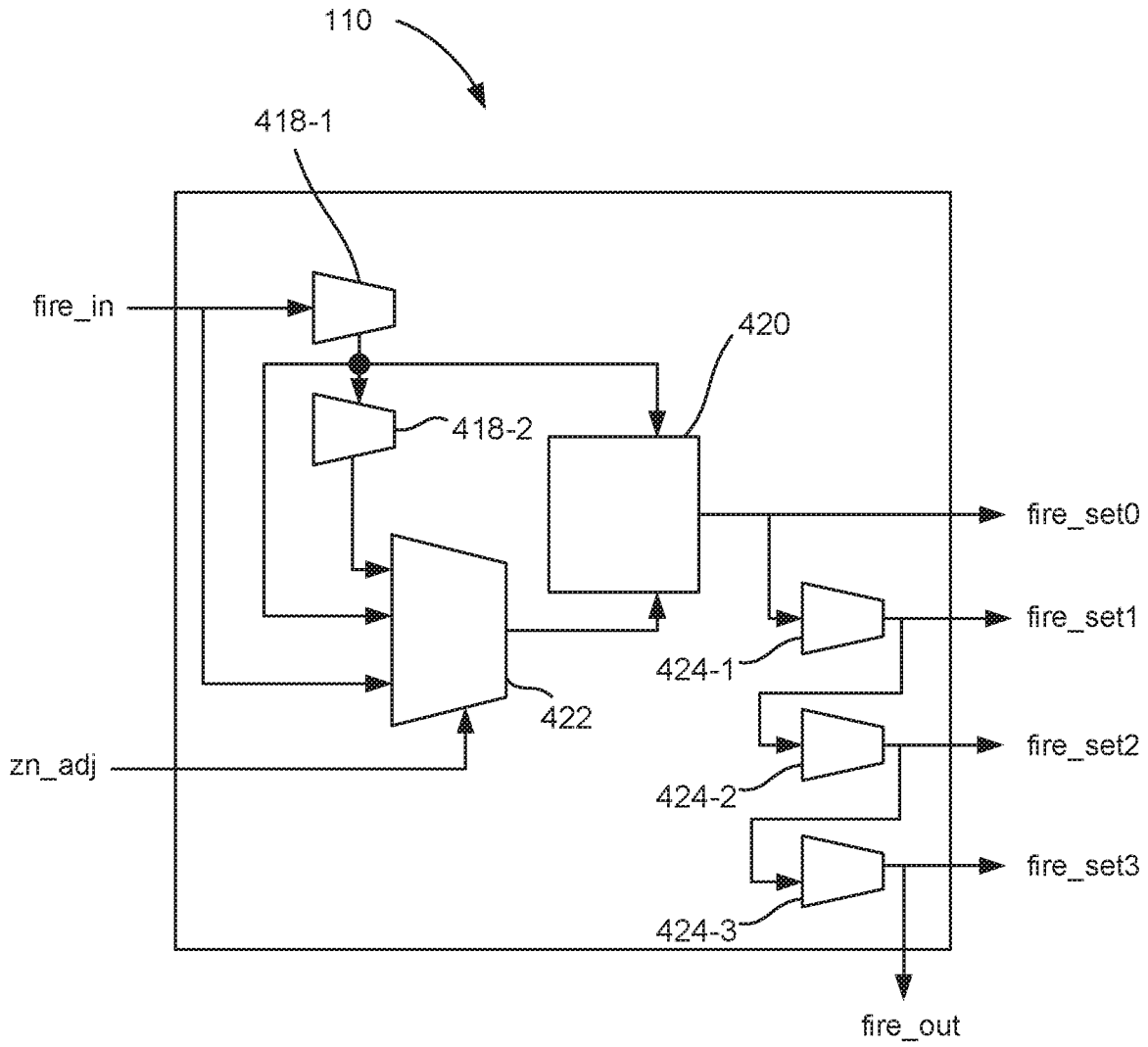
FIG. 4 is a schematic diagram of an adjustment device for a zone, according to an example of the principles described herein.
Figure 7:
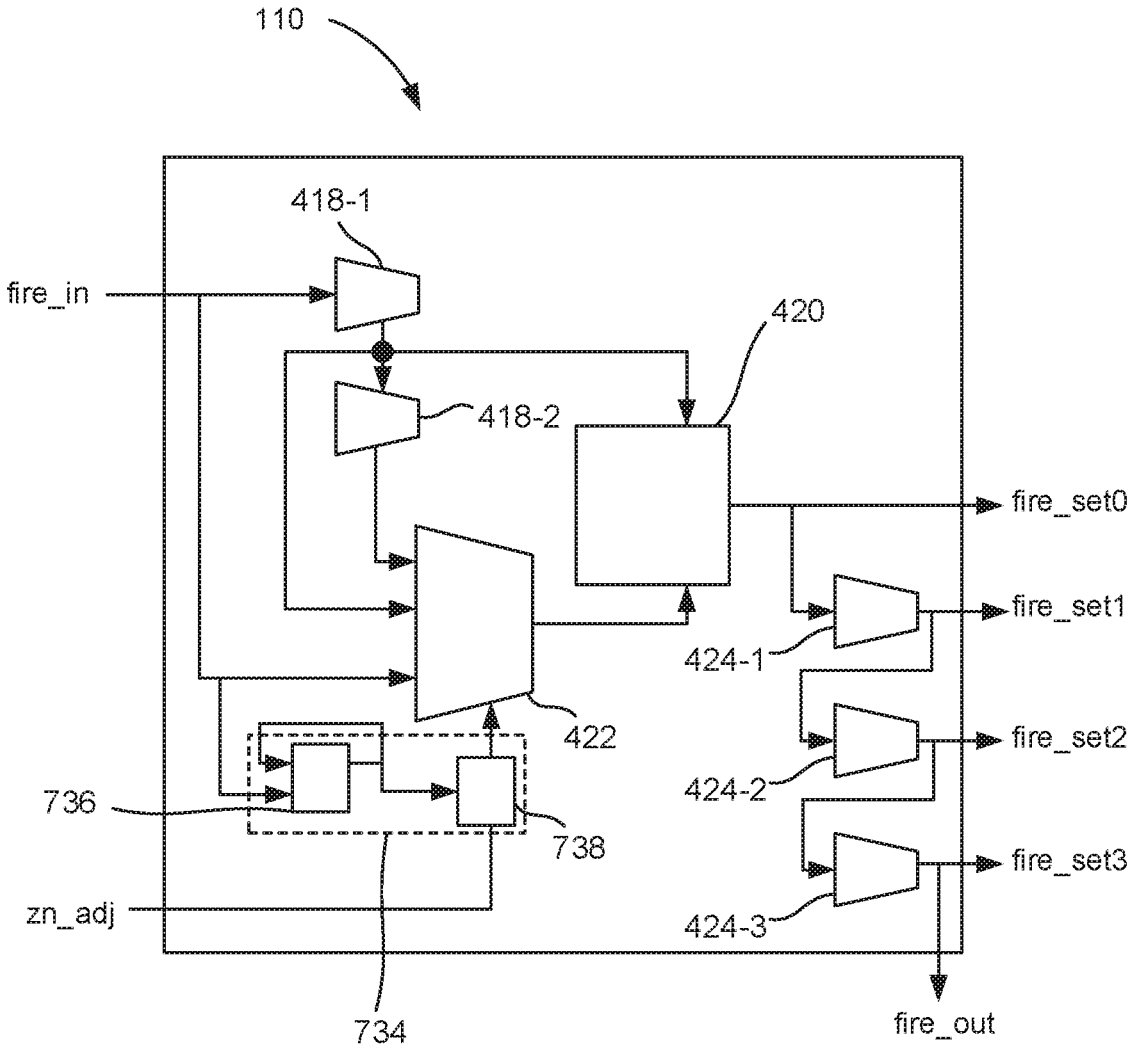
FIG. 7 is a schematic diagram of an adjustment device die for zonal firing signal adjustments, according to another example of the principles described herein.

FIG. 4 is a schematic diagram of an adjustment device (110) for a zone (FIG. 1, 102), according to an example of the principles described herein. As described above, the adjustment device (110) of a zone (FIG. 1, 102) adjusts the firing signal for the entire zone (FIG. 1, 102) and also delays the firing signal per set (FIG. 1, 104). In one example, the adjustment device (110) adjusts a width of the firing signal to either increase the energy or reduce the energy provided by the firing signal. Accordingly, the adjustment device (110) as described herein trims or extends the firing signal. In the example depicted in FIG. 4, the firing signal includes a single pulse. FIG. 7 below depicts an adjustment device (110) when the firing signal includes multiple pulses.

In some examples, the degree to which a firing signal is adjusted is bound to be within a threshold range. Doing so smooths the adjustments that are made. That is, if adjustments are too large, print quality defects, or discontinuities may be identifiable in a printed product.

In the example depicted in FIG. 4, the firing signal may be delayed at each zone (FIG. 1, 102) by one delay unit, where one delay unit corresponds to the delay imposed by a delay device (418). That is, the firing signal may be extended by one delay unit, reduced by one delay unit, or maintained the same. The delay unit of a delay device (418) may be selected based on the application. For example, the delay unit may be 20 nanoseconds. Accordingly, in the example depicted in FIG. 4, the firing signal at a particular zone (FIG. 1, 102) may be shortened by 20 nanoseconds, lengthened by 20 nanoseconds, or maintained the same. Other delay units may be implemented as well. While FIG. 4 depicts adjusting the firing signal by a single delay unit, some adjustment devices (110) may be able to adjust the firing signal by more delay units. For example, an adjustment device (110) may be able to adjust the firing signal by one delay unit in either direction and/or two delay units in either direction. To do so additional zone delay devices (418) would be implemented and more inputs to the adjustment logic (422) as they are described herein.

In this example, a firing signal, fire_in, signal is received at the adjustment device (110). The firing signal, fire_in, may have been adjusted at a preceding zone (FIG. 1, 102). In this example, the adjustment device (110) includes at least two zone delay devices (418-1, 418-2). The firing signal, fire_in, is passed by the at least two zone delay devices (418-1, 418-2) to generate a first version, a second version, and a third version of the firing signal fire_in.

Each version of the firing signal, fire_in, is associated with a different delay amount and in some cases a different adjustment value. For example, before reaching the first zone delay device (418-1), a first version is generated which has a delay amount. After passing through the first zone delay device (418-1), a second version is generated which has a delay amount that is greater than the first version. After passing through the second zone delay device (418-2), a third version is generated which has a delay amount that is greater than both the first and the second versions. An output of the first zone delay device (418-1), i.e., the second version, is passed to the control logic (420) which triggers a rising edge of the adjusted firing signal to the first set (FIG. 2, 104-1), fire_set0, of the zone (FIG. 1, 102). That is, the adjusted firing signal at each set (FIG. 1, 104) is defined by a rising edge and a falling edge. In this example, the second version triggers the rising edge such that a delay (from the first zone delay device (418-1)) is imposed. This delay ensures that the firing of the first set (FIG. 2, 104-1) of the current zone (FIG. 1, 102) is different than the immediately preceding set (FIG. 1, 104) which was in a different zone (FIG. 1, 102).

Each version is also passed to adjustment logic (422). The adjustment logic (422) determines which of the first version, second version, and third version is to trigger a falling edge of the adjusted firing signal. That is the adjustment logic (422) may include a multiplexing device that can indicate which of a desired input to generate as output.

As each of the first, second, and third version have a different delay, each one may alter the length of the firing signal. For example, as the rising edge corresponds to the second version, if the same second version triggers the falling edge, the adjusted firing signal width would match that of the previous set (FIG. 1, 104). By comparison, as the first version has a shorter delay, selecting the first version to trigger the falling edge would truncate the adjusted firing signal by one delay unit. Still further, as the third version has a longer delay than the second version, selecting the third version to trigger the falling edge would extend the adjusted firing signal by one delay unit.

Figure 6:
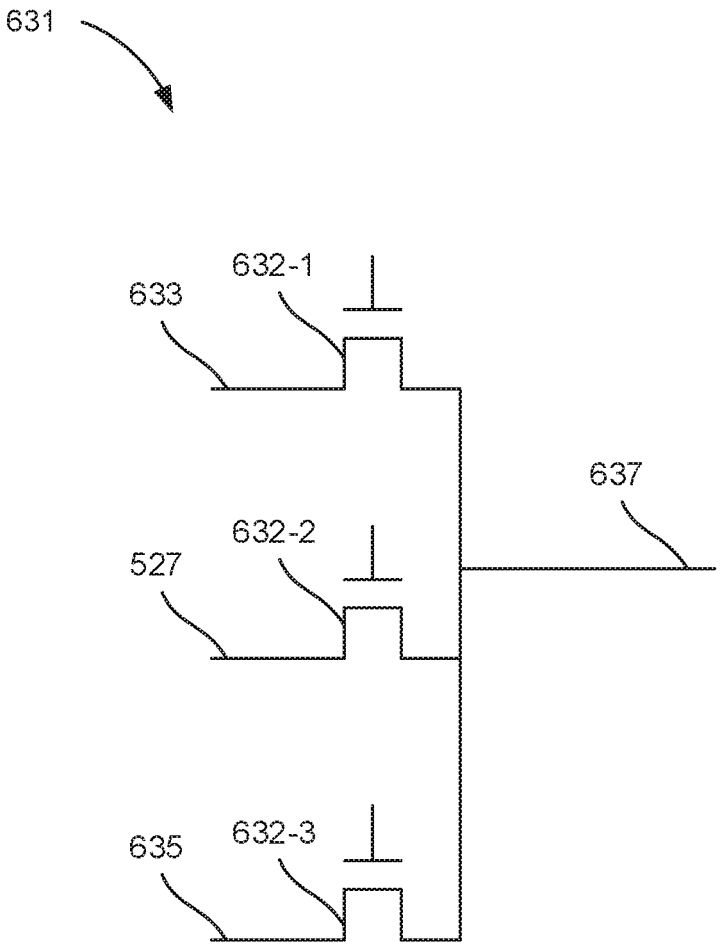
FIG. 6 is a circuit diagram of adjustment logic of the adjustment device for a zone, according to an example of the principles described herein.

The version that is selected to trigger the falling edge is determined based on the zn_adj signal, which as described above is passed to the adjustment device (110) from the controller (FIG. 2, 214) and indicates an amount to adjust the firing signal within the zone (FIG. 1, 102). For example, if the zone (FIG. 1, 102) in question is warmer, then the zn_adj signal for this zone (FIG. 1, 102) may direct the adjustment logic (422) to pass the first version which would result in a truncated firing signal. By comparison, if the zone (FIG. 1, 102) in question is cooler, then the zn_adj signal for this zone (FIG. 1, 102) may direct the adjustment logic (422) to pass the third version, which would result in an extended firing signal. A specific example of the adjustment logic (422) is depicted in FIG. 6 below.

The output of the adjustment logic (422) is passed to the control logic (420) which sets the falling edge of the firing signal and passes the adjusted firing signal to the first set (FIG. 1, 104) of the zone (FIG. 1, 102). In some examples, the control logic (420) is an S-R latch with a set pin and a reset pin. When the set pin is activated the output goes to 1 and when the reset pin is activated, the output goes to 0. Accordingly, the second version activates the set pin such that an output of 1 is generated, which represents the rising edge of the adjusted firing signal. Then based on the output of the adjustment logic (422) the reset pin is activated such that the output of 0 is generated, which represents the falling edge of the adjusted firing signal. While particular reference is made to an S-R latch, other types of control logic (420) may be implemented in accordance with the principles described herein.

Moreover, the example presented above indicates how to adjust a falling edge of the firing signal. However, a rising edge of the firing signal could be adjusted by reversing the inputs on the S-R latch and making corresponding adjustments to how the zone adjust signal, zn_adj, selects which of the versions is used to set the R-S latch.

The adjustment device (110) also includes delay devices (424-1, 424-2, 424-3) per each subsequent set (FIG. 1, 104) to delay the adjusted zone firing signal per set (FIG. 1, 104). That is, the adjusted firing signal as it leaves the control logic (420) is passed to a first set delay device (424-1) which temporally delays the adjusted firing signal. This delayed and adjusted firing signal is then passed to a second set delay device (424-2) where it is further delayed, but not adjusted. The adjusted and delayed firing signal leaving the third set delay device (424-3), in addition to passing to the third set (FIG. 2, 104-3), is also passed as an adjusted firing signal fire_out. This adjusted firing signal, fire_out, signal is a firing signal, fire_in, signal for another zone (FIG. 1, 102) and the adjustment device (110) for that zone (FIG. 1, 102) operates as described herein to generate a firing signal adjusted for that zone (FIG. 1, 102). Thus, each zone (FIG. 1, 102) generates a firing signal that is uniquely tailored to that zone (FIG. 1, 102) such that a desired fluid drop weight is ensured.

In addition to zonally customized firing signals, the present adjustment device (110) adds just one delay element, one instance of adjustment logic (422), and one instance of control logic (420) per thermal zone (FIG. 1, 102). Thus little circuit space is occupied by components that effectuate the adjusted firing signal which adjusted firing signal greatly improves the operation of an associated fluidic die (FIG. 1, 100) and fluid system (FIG. 2, 212).

Figure 5:
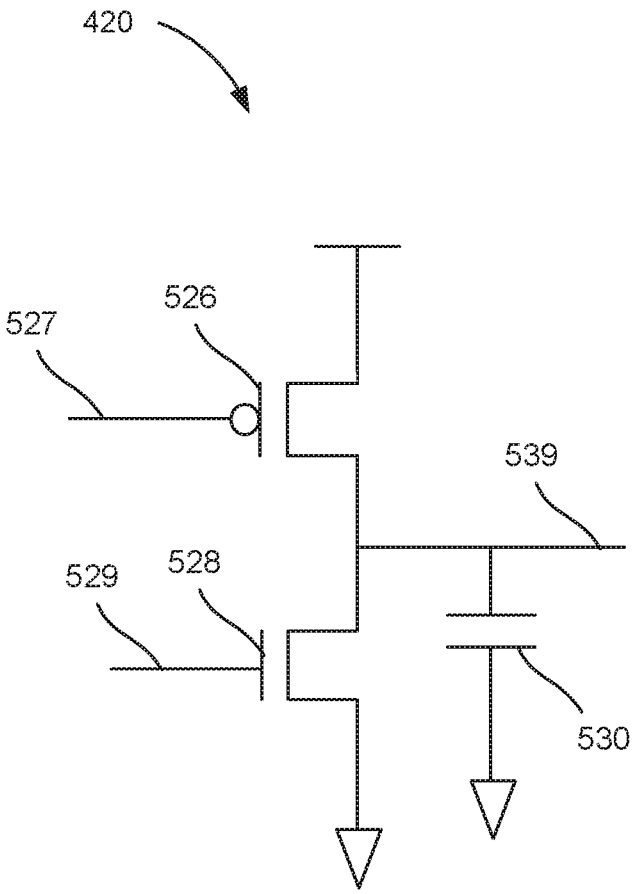
FIG. 5 is a circuit diagram of control logic of the adjustment device for a zone, according to an example of the principles described herein.

FIG. 5 is a circuit diagram of control logic (420) of the adjustment device (FIG. 1, 110) for a zone (FIG. 1, 102), according to an example of the principles described herein. In this example, the second version (527) of the firing signal is input to a PMOS type transistor (526) and the output (529) of the adjustment logic (FIG. 4, 422) is input to an NMOS type transistor (528). When the second version (527) is input, and in this case the activating signal would be a transition to a low, 0, value, the capacitor (530) is pulled high, thus indicating the rising edge. Then when the reset is active, which in this case is a high value, via the output (529) of the adjustment logic (FIG. 4, 422), the capacitor (530) is pulled low, thus indicating the trailing edge. In this example, the output (539) is the adjusted firing signal to the first set (FIG. 2, 104-1), fire_set0, of the zone (FIG. 1, 102). Again, while FIGS. 4 and 5 make particular reference to certain circuit elements, the adjustment device (FIG. 1, 110) and more particularly, the control logic (420) may be formed of other circuit elements.

FIG. 6 is a circuit diagram of a multiplexer (631) of the adjustment logic (FIG. 4, 422) for a zone (FIG. 1, 102), according to an example of the principles described herein. In this example, each of the versions (633, 527, 635) of the firing signal, fire_in, may be passed to a different transistor (632). Each of the transistors (632) may be either of NMOS type or PMOS type field-effect transistors (632). For example, the first version (633) may be passed to a first transistor (632-1), the second version (527) to the second transistor (632-2), and the third version (635) to the third transistor (632-3). In this example, the zone_adj activates the gate of one of the transistors (632) based on the determined adjustment value. In this example, the output (637) activates the corresponding pin on the control logic (FIG. 4, 420).

FIG. 7 is a schematic diagram of an adjustment device (110) for zonal firing signal adjustments, according to another example of the principles described herein. As described above, the adjustment device (110) includes at least two zone delay devices (418), adjustment logic (422), control logic (420), and set delay devices (424) coupled to different sets (FIG. 1, 104) of fluidic devices (FIG. 1, 106).

In this example, the adjustment device (110) also includes a pulse selection device (734) to select which of at least one pulse of a firing signal to adjust. That is, a firing signal may have multiple pulses. For example, a precursor pulse may serve to warm the actuator in a fluidic device (FIG. 1, 106) to a particular temperature. Then, when the firing pulse of the firing signal is received, the actuator is warmed to a firing temperature. In this example, either of the firing pulse or the precursor pulse may be adjusted to maintain drop weight.

The pulse selection device (734) enables the adjustment logic (422) when just one of the pulses is active. Specifically, a toggle flop (736) is activated by the first version of the fire_in signal. That is, the toggle flop (736) is initially set to zero. When a leading edge of the first, i.e., precursor, pulse arrives, the toggle flop (736) toggles to a 1 which allows the adjustment logic (422) to adjust the first, or precursor, pulse. When the second leading edge arrives, i.e., the leading edge of the second or firing pulse, the toggle flop (736) toggles to a 0 and that disables the adjustment logic (4222) so it won't adjust the second pulse. This generates an output that is passed to enable logic (738). The enable logic (738) allows the zon_adj signal to pass when the enable logic (738) is activated. Accordingly, the adjustment logic (422) just operates when desired.

Figure 8:
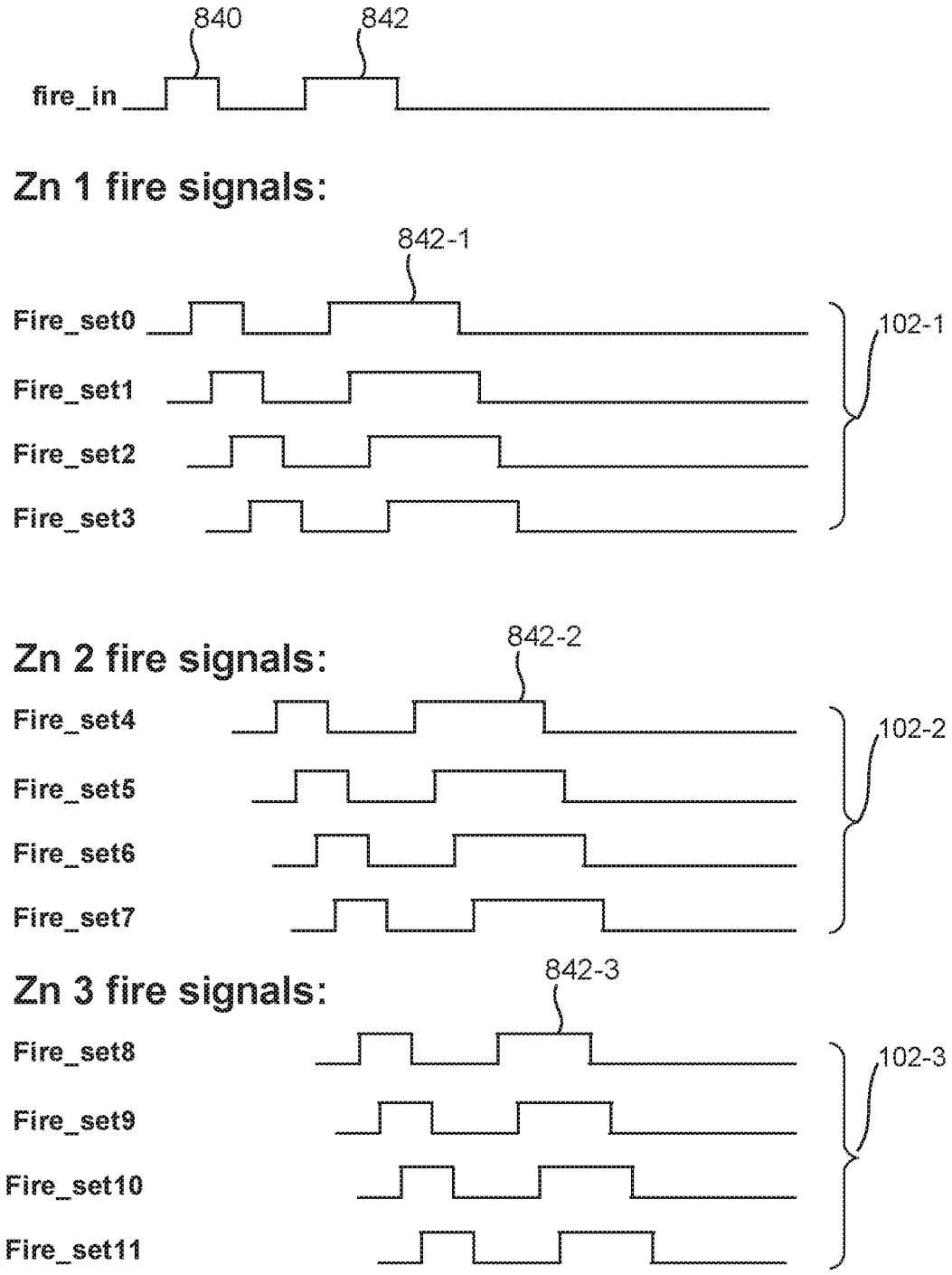
FIG. 8 is a diagram illustrating adjusted zone firing signals, according to an example of the principles described herein.

FIG. 8 is a diagram illustrating adjustment of a firing signal through different zones (102-1, 102-2, 102-3), according to an example of the principles described herein. In this example, the firing signal, fire_in, represents a firing signal as it is received at a first zone (102-1). Note that in this example, the firing signal includes multiple pulses, specifically, a precursor pulse (840) and a firing pulse (842).

At some point in time, the controller (FIG. 2, 214) receives a sensor (FIG. 1, 108) reading from a sensor (FIG. 1, 108) in a first zone (102-1) indicating that an energy adjustment is needed to produce a desired drop weight at the first zone (102-1). Accordingly, the adjustment device (FIG. 1, 110) of the first zone (FIG. 1, 102-1) adjusts the firing pulse. This is indicated in FIG. 8 as the increased length of the firing pulse (842-1) in the first zone (102-1). As the firing signal propagates through the first zone (102-1) it is delayed at each set (FIG. 1, 104). The adjusted firing signal as it leaves the last set (FIG. 1, 104-4) passes to the second zone (102-2).

At some point in time, the controller (FIG. 2, 214) receives a sensor (FIG. 1, 108) reading from a sensor (FIG. 1, 108) in the second zone (102-2) indicating that no adjustment is to be made to the firing signal relative to how it was received from the last set (FIG. 1, 104-4) of the first zone (102-2). This is indicated in FIG. 8 as the firing pulse (842-2) in the second zone has the same width as it did in the first zone (102-1). Similarly, as the firing signal propagates through the second zone (102-2) it is delayed at each set (FIG. 1, 104). The firing signal as it leaves the last set (FIG. 1, 104-4) passes to the third zone (102-3).

At some point in time, the controller (FIG. 2, 214) receives a sensor (FIG. 1, 108) reading from a sensor (FIG. 1, 108) in the third zone (102-3) indicating that the firing pulse should be shortened relative to how it was received from the last set (FIG. 1, 104-4) of the second zone (102-2). This is indicated in FIG. 8, as the firing pulse (842-3) in the third zone (102-3) has the shorter width than it did in the second zone (102-2).

FIG. 9 is a schematic diagram of a controller (214) of the fluidic system (FIG. 2, 212) for zonal firing signal adjustments, according to an example of the principles described herein. In the example depicted in FIG. 9, the fluidic die (FIG. 1, 100) includes three zones (102-1, 102-2, 102-3). However any number of zones (102) may be implemented on a fluidic die (FIG. 1, 100). As described above, the controller (214) calculates a value by which the firing signal is to be adjusted within each zone (102). For example, the controller (214) may determine a modification to a width of a firing signal at each zone (102) before using the firing signal in the zone (102). The value is then passed to the zone (102) where it can be used to modify the firing signal in that zone (102). The modified firing signals are propagated through other zones (102) where it is modified further. Accordingly, in this example the pulse width of each zone (102) is uniquely set to compensate for temperature induced drop weight variations.

As described above, each zone (102) includes a sensor (108) such as a temperature sensor (FIG. 2, 216) to measure a characteristic, such as a temperature, for the zone (FIG. 1, 102). This characteristic is then passed to the controller (214) and converted into a value representative of pulse width adjustment. Accordingly, the controller (214) may include any number of converters to convert the temperatures into values related to pulse width adjustments. Specifically, an output of the converters may be values such that one increment in the value results in one unit of pulse length adjustment. Such converters include a scale and offset device (944) and an analog-to-digital converter (946). While specific reference is made to particular types of converters, other types of converters and additional signal conditioners may be implemented.

The controller (214) also includes registers (948) and (950) to store different values that map to particular temperatures. That is, the adjustment made to the firing signal in a particular zone (102) is based on the difference between a temperature for that zone and a reference temperature. In some examples, such as depicted in FIG. 9, the reference temperature is a temperature of a first zone (102-1) on a fluidic die (FIG. 1, 100). The controller (214) includes a reference register (948) to store a reference value associated with the reference temperature.

The controller (214) also includes a temperature register (950) to store a value associated with the temperature of a zone (102) whose firing signal is to be adjusted. The zone (102) whose firing signal is to be adjusted is activated via an activation signal passed along an activation bus (961) that 1) couples the corresponding sensor (108) to the controller (214) and 2) couples the corresponding register (958) in the zone (102) to the controller (214). Upon activation, the register (958) corresponding to a zone (102) is latched via a latch signal along a latch bus (963).

For example, a first temperature is received from a sensor (108-1) associated with a first, and reference, zone (102-1). The converters convert this to a value and store it in the reference register (948). Next, a temperature from a second zone (102-2) is received and similarly converted to produce an evaluation value associated with the temperature from the second zone (102-2). A switch in the controller (214) directs this evaluation value to the temperature register (950) where it is stored.

Continuing this example, both the reference value and the evaluation value are passed to an evaluator (952) to evaluate a difference between the reference value and the evaluation value and in doing so generating a delta value that indicates the difference. The delta value is then passed to an accumulated comparator (954) to compare the delta value with an accumulated adjustment value. The accumulated adjustment value indicates the degree to which the original firing signal has been changed throughout its propagation along the zones (102) of the fluidic die (FIG. 1, 100). An adjustment value for the zone is then generated based on this comparison.

If the delta value is less than the accumulated adjustment value, an adjustment value within the predetermined range is passed to the corresponding zone (102) that shortens the firing signal. By comparison, if the delta value is greater than the accumulated adjustment value, an adjustment value is passed to the corresponding zone (102) that lengthens the firing signal. Lastly, if the delta value is the same as the accumulated adjustment value, an adjustment value is passed to the corresponding zone (102) that maintains the firing signal. This adjustment value is passed to the associated register (958) on the zone (102) along an adjust bus (959) and used therein to adjust a firing signal. Note that in FIG. 9, the adjust bus (959) includes multiple wires coupled, each coupled to an output of the accumulated comparator (954).

As described above, in some examples the amount by which a firing signal is adjusted is equal to one delay unit in either direction. Accordingly, an output of the accumulated comparator (954) may be one value indicating an increase in firing pulse width by one delay unit, a second value indicating a decrease in firing width by one delay unit, or a third value indicating a maintenance of the firing pulse width.

This adjustment value is also passed to an accumulator (956) that keeps track of the accumulated adjustments up to the current zone (102).

FIG. 10 is a table for zonal firing signal adjustments, according to an example of the principles described herein. Specifically FIG. 10 depicts how the firing signal at each zone (FIG. 1, 102) is adjusted. In this example, Zone 0 is the reference zone (FIG. 1, 102), meaning it has a target temperature against which all others are compared. In this example, a reference value of 50 is indicated and stored in the reference register (FIG. 9, 948) to represent this reference temperature. Next, for Zone 1, an evaluation value of "51" is stored. This increased evaluation value indicates that Zone 1 has a temperature greater than Zone 0. As indicated above, the mapping between the temperatures received and the values stored in the registers may be such that a difference of 1 indicates one difference in pulse width adjustment length. For example, a difference of 1 may result in a 20 nanosecond delay in triggering the falling edge of the firing pulse. This evaluation value of 51 is received at the temperature register (950). The evaluator (FIG. 9, 952) determines the difference between the reference value and the evaluation value as a delta value, DV0, of −1. The delta value, DV0, is then compared to the accumulated adjustment value, which in this first iteration is a zero. The results of this comparison is passed as the adjust value, ZAV, for Zone 1. This value is also passed to the accumulator (FIG. 9, 956) to be tracked.

Then for Zone 2, an evaluation value of 51 is again received at the temperature register (950). The evaluator (FIG. 9, 952) determines this difference resulting in a delta value, DV0, of −1 as it is one unit different than the reference value of 50. The DV0 for Zone 2 is compared against the accumulated adjusted value of −1 to determine how to adjust the firing signal for Zone 2. As they are the same, there is no adjustment, i.e., ZAV of 0 for Zone 2. As there was no adjustment to the zone firing signal in Zone 2, the accumulated adjustment value does not change.

Turning now to Zone 3. In this case, an evaluation value of 53 was passed indicating an increase in temperature. Accordingly, when compared to the reference temperature, the DV0 value for Zone 3 is −3. As this number is less than the accumulated adjustment value, −1, it is determined that the firing pulse for Zone 3 should be further shortened. Accordingly, the ZAV for Zone 3 is also set to −1 which reduces the firing signal length. As can be seen in the table in FIG. 10, the ZAV is within a predetermined range, regardless of the difference in temperature of adjacent zones (FIG. 1, 102). Doing so ensures a smooth adjustment. If the adjustments are too choppy, then print quality artifacts may be visible in the resulting product. Accordingly, by limiting how much a pulse width can be adjusted, the discontinuity in drop size is also limited.

Figure 11:
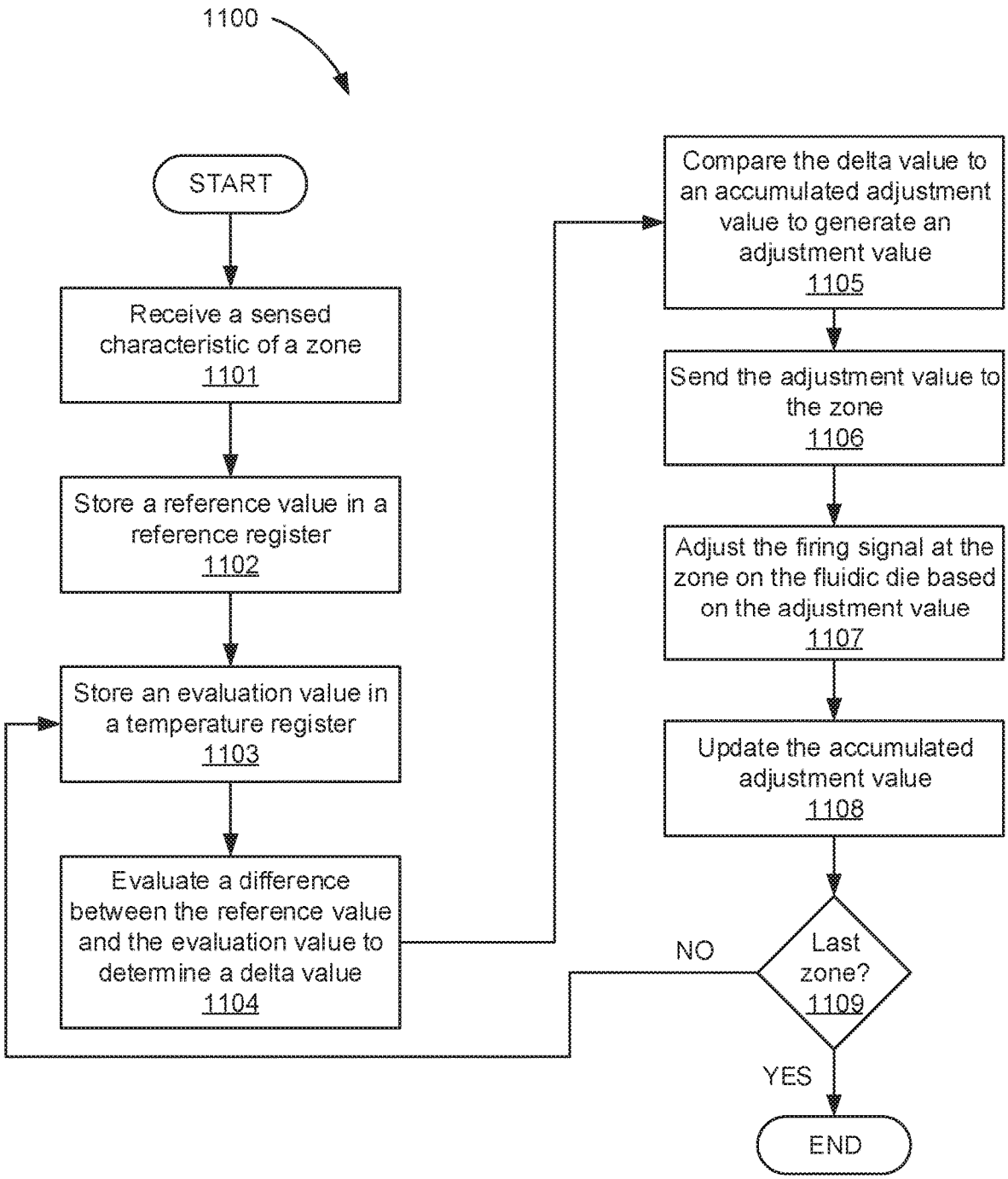
FIG. 11 is a flow chart of a method for zonal firing signal adjustment, according to another example of the principles described herein.

FIG. 11 is a flow chart of a method (1100) for zonal firing signal adjustment, according to another example of the principles described herein. According to the method (1100), a value corresponding to a sensed characteristic is received (block 1101) for a zone (FIG. 1, 102) at a controller (FIG. 2, 214). If the received (block 1101) value is from a reference zone (FIG. 1, 102) which may be a first zone (FIG. 1, 102) on a fluidic die (FIG. 1, 100), this value may be stored (block 1102) in a reference register (FIG. 9, 948). If the value is from a zone (FIG. 1, 102) in which a firing signal is to be adjusted, the value may be stored (block 1103) in a temperature register (FIG. 9, 950). As described above, the value is on a scale such that one increment in value equates to one unit of pulse length adjustment.

In some examples, an initial pulse width is selected from which adjustments are made. The initial pulse width may be based on the reference zone temperature and may be independent of the other zones. Accordingly, receiving (block 1101) the reference value may include receiving a reference temperature and determining the reference value or looking up the reference value in a lookup table.

As described above, a difference between the stored reference value and evaluation value is evaluated (block 1104). Based on this evaluation, a delta value is generated. The delta value indicates the difference between the currently evaluated temperature and the reference temperature. This delta value is used to determine what adjustment, if any, should be made to the firing signal of a particular zone. That is, if the delta value for a particular zone is greater than an accumulated adjustment value, it indicates that the firing signal should be adjusted to reduce the firing energy. By comparison, if the delta value for a particular zone is less than an accumulated adjustment value, it indicates that the firing signal should be adjusted to increase the firing energy. Still further if the delta value for a particular zone is the same as the accumulated adjustment value it indicates that the firing energy should be maintained. The accumulated adjustment value reflects the firing signal as it leaves each zone.

Accordingly, an adjustment to a current zone is based on what the previous firing signal looks like as defined by the accumulated adjustment value. Accordingly, the delta value is compared (block 1105) against an accumulated adjustment value and an adjustment value for the zone determined and sent (block 1106) to the relevant zone. The zone firing signal is then adjusted (block 1107) as described above, and the accumulated adjustment value updated (block 1108) such that previous adjustments may account for what has already been done.

It is then determined if all zones (FIG. 1, 102) have been processed. If the current zone (FIG. 1, 102) is the last zone (block 1109, determination YES), the process ends. If the current zone (FIG. 1, 102) is not the last zone (block 1109, determination NO), the process returns to storing (block 1103) an evaluation value for the next zone (FIG. 1, 102) and the process repeats.

In summary, using such a fluidic die 1) provides for the identification of any characteristic gradient that may exist across the fluidic die; 2) compensates for the characteristic gradient, or any offset from a base value, based on localized sensing systems; 3) provides on-die calculation of zone adjustment values; 4) provides self-contained thermal accommodation; 5) provides such compensation using minimal additional circuitry components; and 6) is relatively low cost. However, the devices disclosed herein may address other matters and deficiencies in a number of technical areas.

What is claimed is:

1. A fluidic die, comprising:
a number of zones, each zone comprising:
a number of sets of fluidic devices, each fluidic device comprising a fluid chamber and a fluid actuator disposed in the fluid chamber;
a sensor to sense a characteristic of the zone; and
an adjustment device to:
delay a firing signal received from a previous zone as it passes by each. set of fluidic devices;
adjust, as instructed by a controller, the firing signal received from the previous zone as it enters the zone based on:
the sensed characteristic of the zone; and
an adjustment made to the firing signal as it is received at the zone from the previous zone; and
pass an adjusted firing signal to a subsequent zone.

2. The fluidic die of claim 1, wherein:
the sensor is a temperature sensor; and
the firing signal is adjusted based on a sensed temperature.

3. The fluidic die of claim 1, wherein the adjustment device:
delays the firing signal at each set of fluidic devices; and
adjusts the firing signal once per zone.

4. The fluidic die of claim 1, wherein the adjustment device is to:
adjust a width of the firing signal relative to how it is received from the previous zone; and
pass an adjusted firing signal to a subsequent zone.

5. The fluidic die of claim 1, further comprising a pulse selection device to select which of at least two pulses of the firing signal to adjust.

6. The fluidic die of claim 1, wherein the adjustment device comprises:
at least two zone delay devices to generate at least a first version, a second version, and a third version of the firing signal, each version being associated with a different delay amount, wherein a rising edge of an adjusted firing signal is triggered by the second version;
adjustment logic to select, based on an adjustment signal, which of the first version, second version, and third version is to trigger a falling edge of the adjusted flung signal;
control logic to pass the adjusted firing signal to a first set of fluidic devices; and
a set delay device per subsequent sets of fluidic devices to delay the adjusted firing signal per set.

7. A fluidic system, comprising:
a fluidic die comprising:
a number of zones, each zone comprising:
a number of sets of fluidic devices;
a temperature sensor; and
an adjustment device to:
delay a firing signal received from a previous zone as it passes by each set of fluidic devices;
serially adjust, as instructed by a controller, the firing signal received from the previous zone based on a sensed temperature of the zone and an adjustment made to the firing signal as it is received at the zone from the previous zone, the adjustment to account for variation in drop weight based on the sensed temperature; and
pass an adjusted firing signal to a subsequent zone; and
the controller:
coupled to temperature sensors and adjustment devices for multiple zones; and
to determine an adjustment value for the firing signal for each zone.

8. The fluidic system of claim 7, wherein the controller is disposed on the fluidic die.

9. The fluidic system of claim 7, wherein the controller is off-die.

10. The fluidic system of claim 7, wherein the controller:
receives sensed temperatures from the temperature sensors;
passes adjustment values to the adjustment devices; and
comprises:
a reference register to store a reference value associated with a reference temperature from a reference zone:
a temperature register to store an evaluation value associated with a temperature of a currently evaluated zone;
an evaluator to evaluate a difference between the reference value and the evaluation value to generate a delta value;
an accumulated comparator to compare the delta value with an accumulated adjustment value to generate adjustment values;
an accumulator to generate the accumulated adjustment value which tracks adjustments to the firing signal across the fluidic die; and
a converter to alter at least one of the reference value and the evaluation value.

11. A method comprising,
receiving from a sensor of a fluidic die, the sensor being coupled to a zone of multiple sets of fluidic devices, a sensed characteristic of the zone;
determining a threshold range for an adjustment value to be applied to a firing signal;
determining a delay unit value for the adjustment value;
determining, based on the sensed characteristic of the zone and an adjustment made to a firing signal received from a previous zone as it enters the zone, the adjustment value to apply to the firing signal received at the zone from the previous zone, wherein the adiustment value is within the threshold range and is an integer value of the delay unit value;

adjusting the firing signal, at the zone on the fluidic die, based on the adjustment value; and passing an adjusted firing signal to a subsequent zone.

12. The method of claim 11, wherein:

the firing signal comprises at least one of a precursor pulse and a firing pulse; and adjusting the firing signal comprises adjusting at least one of the precursor pule and the firing pulse.

13. The method of claim 11, wherein adjusting the firing signal is based on the sensed characteristic and an adjustment value from a controller.

14. The method of claim 11, wherein the firing signal is adjusted within a predetermined range.

15. The method of claim 11, wherein determining, based on the sensed characteristic, an adjustment value comprises:

storing a reference value in a reference register, which reference value corresponds to a reference temperature, wherein the reference value is on a scale such that one increment in the reference value equates to one unit of pulse length adjustment;

storing an evaluation value in a temperature register, which evaluation value corresponds to a temperature of a currently evaluated zone, wherein the evaluation value is on a scale such that one increment in the evaluation value equates to one unit of pulse length adjustment;

evaluating a difference between the reference value and the evaluation value to generate a delta value;

comparing the delta value to an accumulated adjustment value to generate an adjustment value for the zone;

sending the adjustment value for the zone to the respective zone, wherein an adjustment value for the zone:

being greater than the accumulated adjustment value adjusts the firing pulse to reduce firing energy;

being equal to the accumulated adjustment value maintains the firing pulse; and being less than the accumulated adjustment value adjusts the firing pulse to increase firing energy; and updating the accumulated adjustment value based on the delta value.

16. The fluidic die of claim 1, wherein the adjustment device is to delay the firing signal multiple times per zone, each delay for a set within the zone.

17. The fluidic die of claim 1, wherein the adjustment device is to determine the adjustment made to the firing signal in the previous zone.

18. The fluidic die of claim 17, wherein the adjustment device is to determine a value of the adjustment made to the firing signal in the previous zone.

19. The fluidic die of claim 1, wherein the adjustment device is to:

generate at least two versions of the firing signal, each version being associated with a different delay amount; and determine which of the at least two versions to pass to fluidic devices in the zone.

20. The fluidic die of claim 1, wherein an adjustment made to the firing signal in the zone is based on a difference between a temperature for the zone and a temperature in a previous zone.

* * * * *